United States Patent [19]

Hagopian

[11] Patent Number: 5,072,468

[45] Date of Patent: Dec. 17, 1991

[54] FLOTATION THERAPY BED FOR PREVENTING DECUBITUS ULCERS

[75] Inventor: Mark Hagopian, Indian Rocks Beach, Fla.

[73] Assignee: Biologics, Inc., St. Petersburg, Fla.

[21] Appl. No.: 643,972

[22] Filed: Jan. 22, 1991

[51] Int. Cl.[5] ..... A47C 27/10; A61G 7/012; A61G 7/057

[52] U.S. Cl. ..... 5/451; 5/63; 5/455

[58] Field of Search ..... 5/451, 450, 455, 453, 5/449, 441, 429, 60, 63, 64, 65

[56] References Cited

U.S. PATENT DOCUMENTS

| | | | |
|---|---|---|---|
| 3,303,518 | 2/1967 | Ingram | 5/456 |
| 3,456,270 | 7/1969 | Weinstein et al. | 5/451 |
| 3,803,647 | 4/1974 | Reswick | 5/451 |
| 3,823,428 | 7/1974 | Whyte | 5/429 |
| 4,638,519 | 1/1987 | Hess | 5/453 |
| 4,685,163 | 8/1987 | Quillen et al. | 5/455 |
| 4,945,588 | 8/1990 | Cassidy et al. | 5/451 |
| 4,953,247 | 9/1990 | Hasty | 5/455 |

FOREIGN PATENT DOCUMENTS

| | | | |
|---|---|---|---|
| 727243 | 9/1942 | Fed. Rep. of Germany | 5/441 |

*Primary Examiner*—Alexander Grosz

*Attorney, Agent, or Firm*—Joseph C. Mason, Jr.; Ronald E. Smith

[57] ABSTRACT

A flotation therapy bed that prevents formation of decubitus ulcers. A three-chambered mattress has three configurations, each having a different utility. In a first configuration, a lowermost chamber is filled with water and the other two chambers are empty so that the patient is supported by the water. In a second configuration, a second chamber, co-extensive with the water-filled chamber, is filled with air. This facilitates turning the patient over, or lifting the patient from the bed. In a third configuration, a third, wedge-shaped chamber is filled with air and holds the patient in a sitting up position. The second chamber is evacuated when the third chamber is filled. A motor-driven linkage raises and lowers the bed in a vertical plane in the absence of longitudinal or transverse movement.

6 Claims, 6 Drawing Sheets

Fig. 7
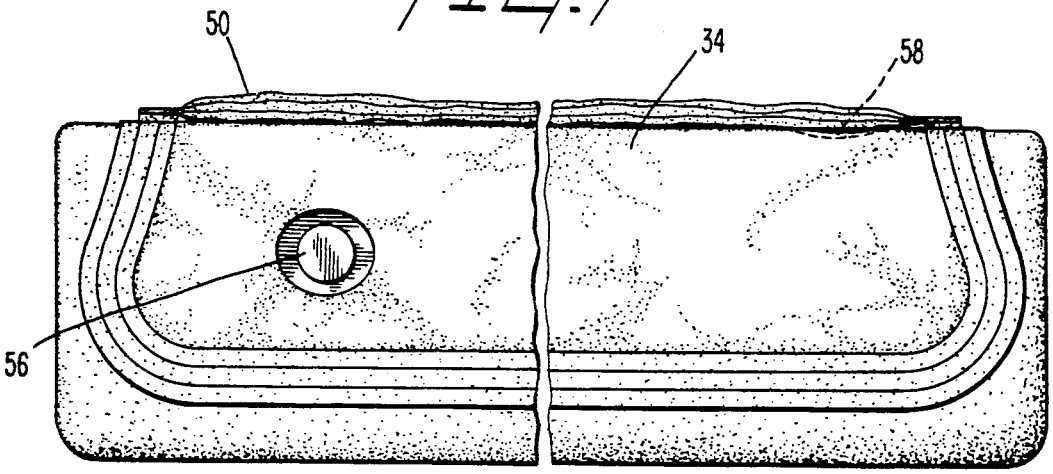
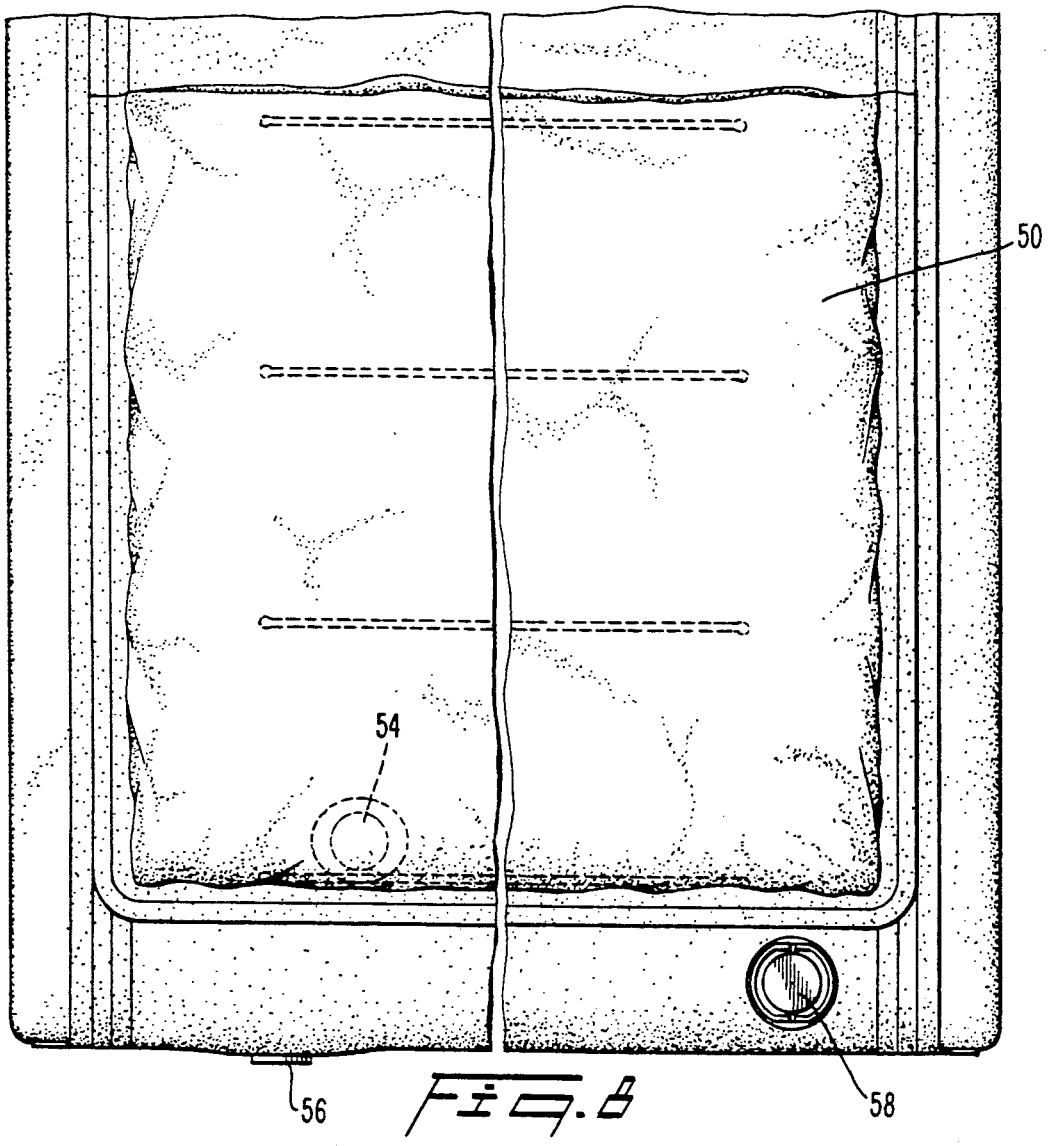
Fig. 8

FLOTATION THERAPY BED FOR PREVENTING DECUBITUS ULCERS

TECHNICAL FIELD

This invention relates, generally, to specialty beds that are designed to minimize the chances of bed sores forming on a bed-ridden patient and to treat preexisting severe bed sores.

BACKGROUND ART

Decubitus ulcers, commonly known as bed sores, are caused when the capillaries of a patient are occluded by pressure over long periods of time. With most people, the capillaries begin to occlude when the pressure thereagainst reaches about thirty two millimeters of mercury (32 mm of Hg).

A conventional bed having a conventional mattress supplies a pressure of about eighty mm of Hg to the capillaries, and this easily causes capillary occlusion. However, most people spend relatively short periods of time in bed and the capillaries recover during the time spent out of bed so bed sores do not develop. Comatose patients, on the other hand, spend long and unrelieved periods of time in bed and such patients will develop bed sores if not turned periodically.

Waterbeds have been used as hospital beds because the capillaries of a patient floating on a water-filled mattress are subjected to only about eight to twelve mm of Hg. Accordingly, waterbeds prevent bed sores. However, they have met with limited acceptance by health care professionals, because it is very difficult to turn and position patients lying on a waterbed. Moreover, it is difficult to lift a patient from a waterbed, or to deposit a patient thereonto.

Due to the widespread problem of decubitus ulcers, many inventors have turned their attention to flotation therapy beds. For example, a flotation therapy bed is mentioned in 48 Federal Register 53034 and 53051, paragraph 890, 5170, dated Nov. 23, 1983.

Moreover, Reswick U.S. Pat. No. 3,803,647 shows a flotation therapy bed for preventing decubitus ulcers by use of a steel hospital bed on casters having an air mattress on top of a tub for an aqueous supporting fluid. The Reswick design includes a heating unit for the supporting fluid which includes a thermostatically controlled electrical heater located in the fluid.

United Kingdom patent no. 2,154,445 discloses a relatively inexpensive and light-in-weight waterbed having a porous cover and a molded plastic base that rests atop a conventional hospital or domestic bed frame. It also includes a low voltage heater and heater controls. Rand U.S. Pat. No. 2,719,986 is also of interest as an additional representative sample of the large body of art that discloses controls for the air portion of mattresses.

Despite the many advances that have been made in this field, patients continue to get bed sores, even when provided with patented beds. This is largely because health care professionals have rejected waterbeds due to the above-mentioned difficulties which such beds present to the care provider.

There is a need for a waterbed construction that facilitates the handling of patients on such a bed, but the prior art, when considered as a whole in accordance with the requirements of law, neither teaches nor suggests how such a bed could be provided.

Moreover, there are some patients who cannot be left lying flat on their backs. Thus, there is a need for a flotation therapy bed capable of supporting patients in a sitting-up position, but the art contains no developments that suggests how such a bed could be provided.

DISCLOSURE OF INVENTION

The longstanding but heretofore unfulfilled need for a flotation therapy bed that is not subject to the limitations of all beds heretofore known, is now provided by a unique construction that includes a mattress having three individual chambers.

A first chamber is filled with temperature-controlled water, a second chamber is filled with air and overlies the water-filled chamber, and a third air-filled chamber positions the patient in a sitting-up position.

More particularly, the novel construction includes an elongate base member having a flat, elongate bottom wall, a pair of upstanding, transversely disposed end walls, and a pair of upstanding, longitudinally extending side walls, all of which are integrally formed with one another and which collectively define an upwardly-opening elongate cavity.

The three chambered mattress is positioned within the cavity. The lowermost chamber has a longitudinal extent and width that corresponds to the length and width of the flat bottom wall of the base member and is supported thereby. Said lowermost chamber is filled or substantially filled with water when the bed is in use and means are provided to regulate the temperature of that water so that the patient is comfortable at all times. Alarm means sound if the temperature falls outside of a preselected range.

The second chamber has a length and width coextensive with the bottom chamber, but it is air-filled when activated. Importantly, however, the second chamber is deflated almost all the time and is inflated only for brief moments as when a patient is being delivered to the bed, taken therefrom, or turned over. Quick inflation and deflation means are provided.

The third chamber has a width coextensive with the common width of the first and second chambers, but its longitudinal extent is only about one-third that of the first-mentioned chambers. It, like the second chamber, is adapted to inflate and deflate rapidly. However, unlike the second chamber, it may be inflated for prolonged periods of time. Its function is to help the patient sit up at about a thirty to thirty five degree angle; accordingly, the third chamber extends from the head end of the second chamber to about mid-length thereof. When inflated, it has a wedge-shaped profile.

The entire bed is raised and lowered by a unique linkage means.

A control panel provides information about selected monitored conditions and allows the bed operator to adjust the temperature of the water in the first chamber and to otherwise manipulate the operating conditions of the bed.

A primary object of this invention is to advance the art of flotation therapy beds.

A more specific object is to advance such art by disclosing, for the first time anywhere in the world, a waterbed that is equipped with means allowing health care professionals to lift patients from the bed, or to turn the patients over, without difficulty.

Another object is to provide a flotation therapy bed that can support a patient in a sitting-up position.

These and many other important objects, advantages, and features of this invention will become apparent in the detailed description of the invention that follows.

The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which:

FIG. 7 is an end view of the mattress when the second chamber is inflated and the third chamber is deflated; and FIG. 8 is a plan view of the mattress, showing the positioning of the ports for admitting and discharging air and water into and from the mattress.

BEST MODES FOR CARRYING OUT THE INVENTION

Figure 1:
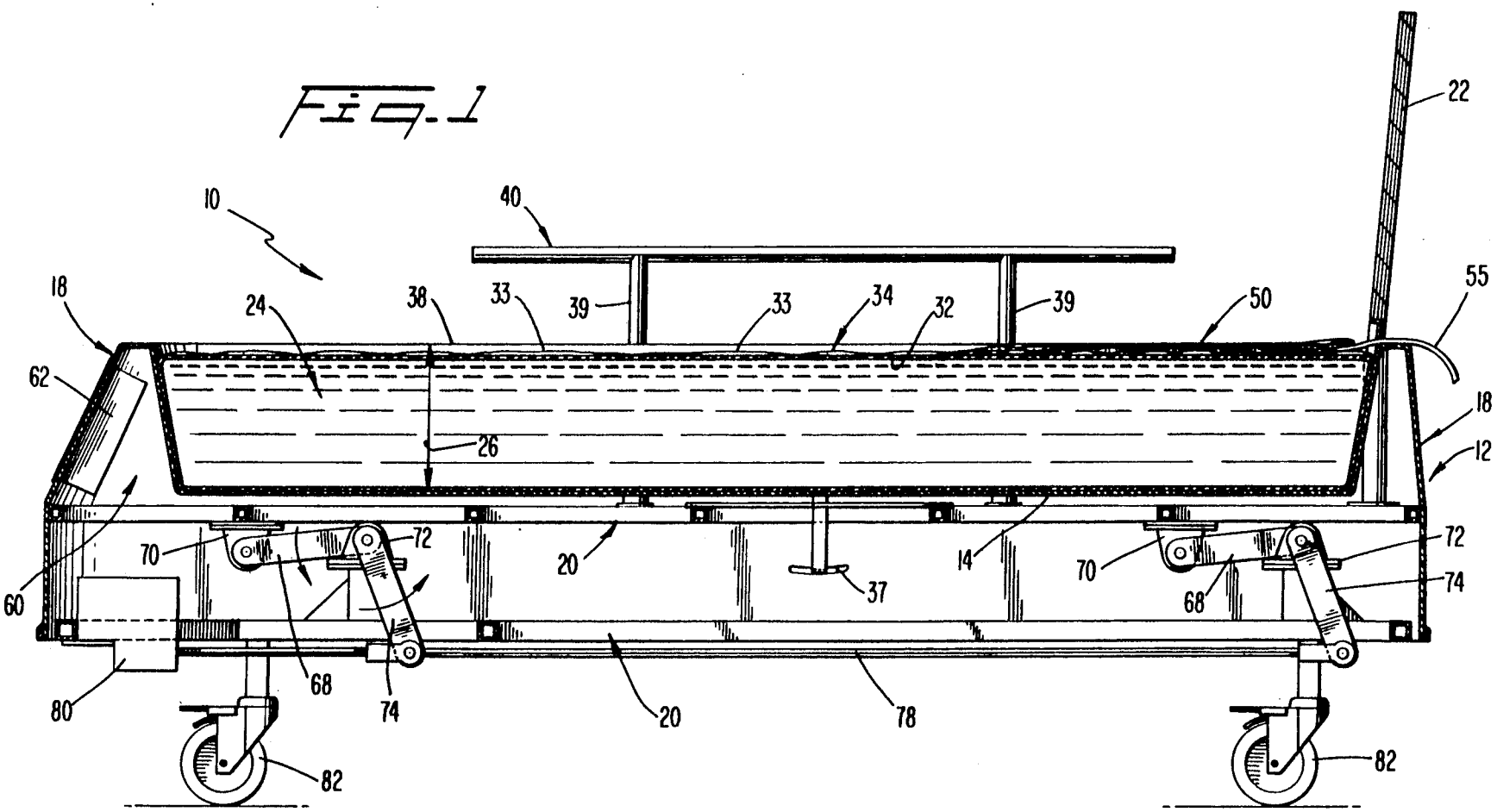
FIG. 1 is a longitudinal sectional view of an illustrative embodiment of the invention, taken along line 1—1 in FIG. 3.

Referring now to FIG. 1, it will there be seen that an exemplary embodiment of the invention is denoted as a whole by the reference numeral 10.

The novel bed 10 includes a monolithic base 12 that is preferably of a glass fiber construction. Base 12 includes a flat bottom wall 14, longitudinally extending side walls 16, (FIG. 3) and transverse end walls 18.

Base 12 is supported by a frame, generally denoted 20, that includes head board 22.

The configuration of base 12 defines an open-topped, flat bottomed cavity or well 24 having a carefully predetermined depth indicated by double-headed arrow 26.

Three chambered mattress, denoted 30 as a whole, has a first chamber 32 adapted to be filled with water. When filled, the depth of the mattress is less than the depth 26 of well 24 by about six inches or so. In this manner, the side walls 14 serve as retainer means that prevent the patient from rolling off the bed.

Figure 2:
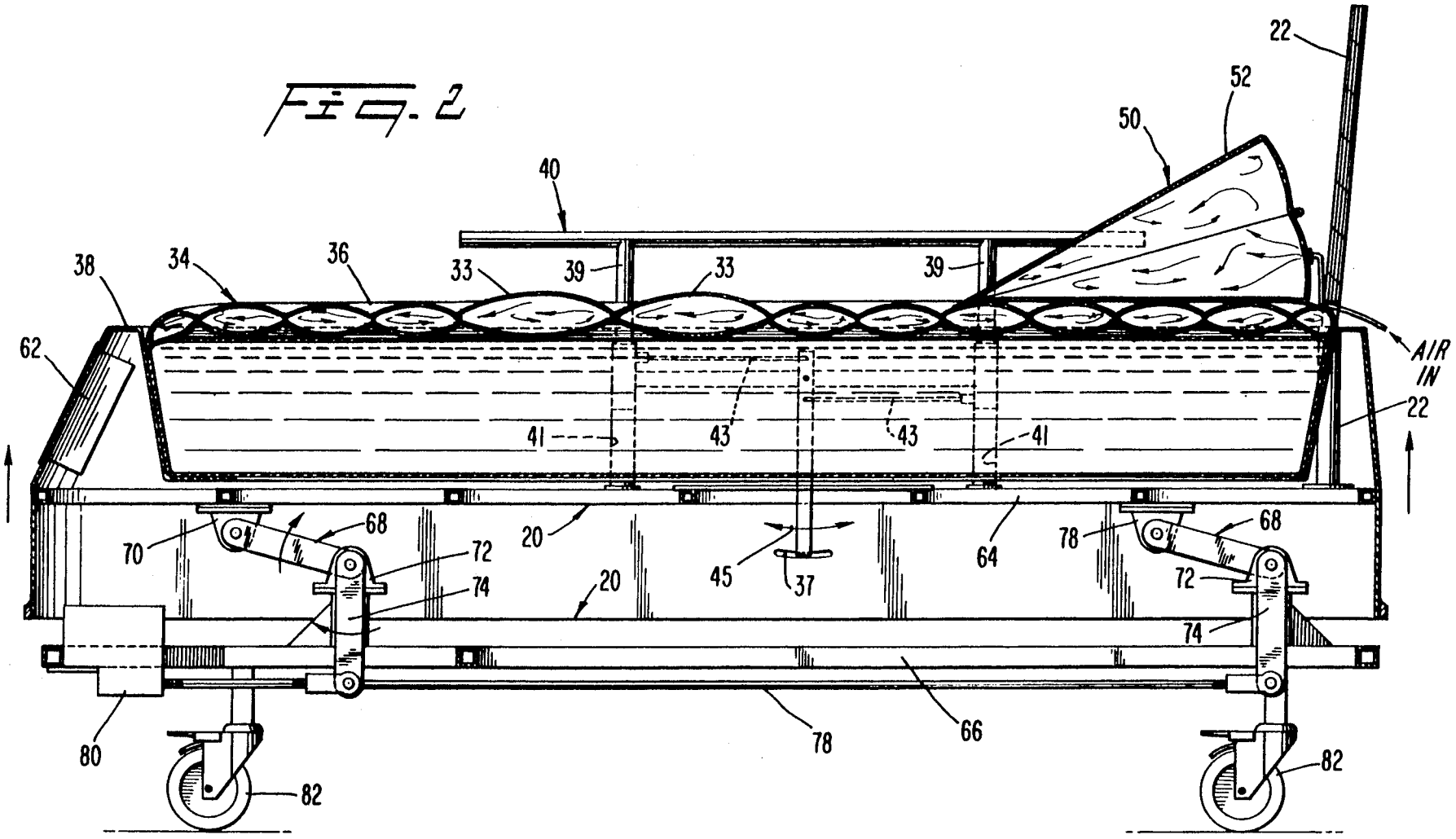
FIG. 2 is a view similar to FIG. 1, but showing the second and third chambers of the novel mattress filled with air.

A second chamber 34, best shown in FIG. 2, overlies first chamber 32 and is adapted to be filled with air. As depicted in FIG. 2, when second chamber or air mattress 34 is inflated, top surface 36 thereof is substantially coplanar with the rim 38 of side walls 14. This enables the health care professional to roll the patient from the bed onto a waiting stretcher. Conversely, it facilitates rolling the patient from a stretcher to the bed. Note that mattress sections 33 are larger than the other sections when inflated; they support the patient's lower back.

Side rails 40 are moveably mounted between a deployed, extended position and a retracted, stored position. Said rails must be extended when the second chamber 34 is inflated and the patient is not ready to be moved. However, the second chamber is inflated only for brief periods of time. The rails, however, are nonetheless maintained in their upwardly deployed configuration even when the second chamber is not inflated, to supplement the protection afforded by side walls 14. As shown in FIG. 2, each rail 40 includes a pair of vertical tubes 39 that are telescopically received in wells 41 formed in their associated side walls 16. A pivotally mounted handle 37 has laterally extending arms 43 that lock side rails 40 in their raised configuration when fully extended as shown in FIG. 2, and that permit lowering of said side rails when handle 37 is moved laterally as indicated by double-headed arrow 45.

A third chamber 50, adapted to be filled with air, overlies second chamber 34 and has a wedge-shaped profile when inflated as shown in FIG. 2. Inclined surface 52 thereof is angled at about 30 degrees–35 degrees relative to a horizontal plane. This angle is sufficient to prevent aspiration of a comatose or other patient lacking the ability to protect themselves from aspiration.

Control means are provided to insure that third section 50 cannot be inflated if second section 34 is already inflated; such double inflation could cause a patient to fall from the bed.

Figure 6:
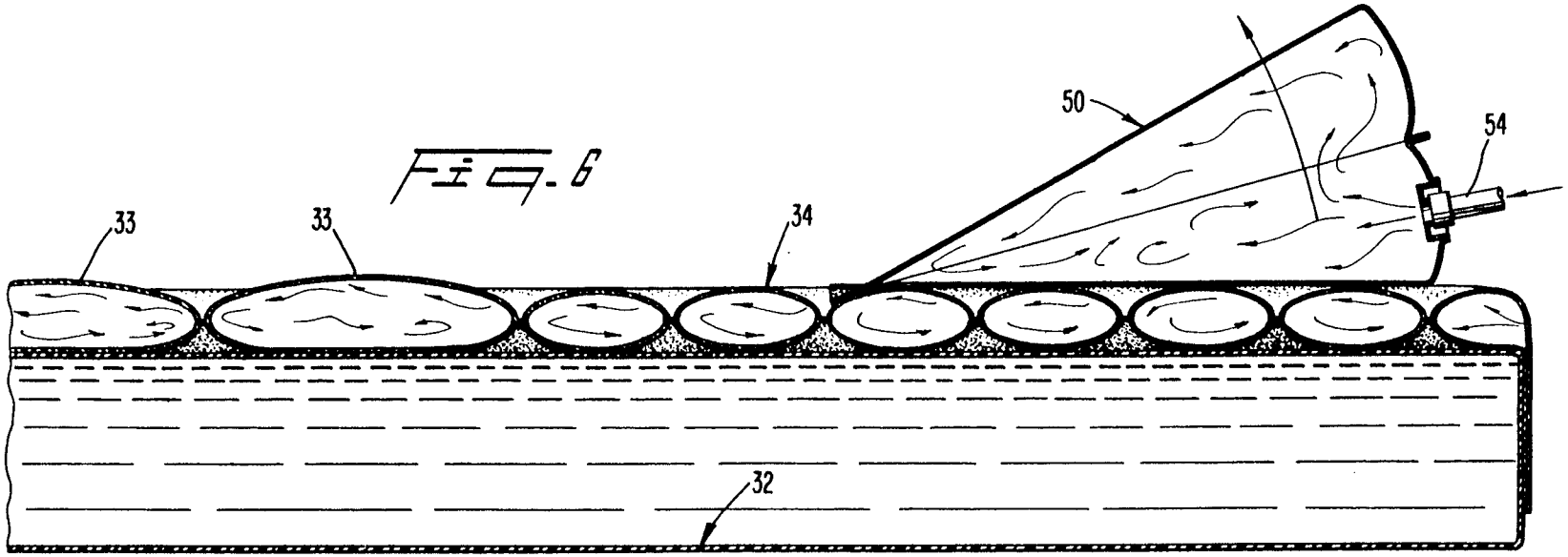
FIG. 6 is a view similar to FIG. 5, but where the third chamber is inflated.

Air is introduced into and withdrawn from third section 50 through port 54, as perhaps best shown in FIG. 6; air hose 55 is shown in FIG. 1.

Air is introduced into and withdrawn from air mattress 34 through port 56, as best shown in FIGS. 7 and 8.

Figure 3:
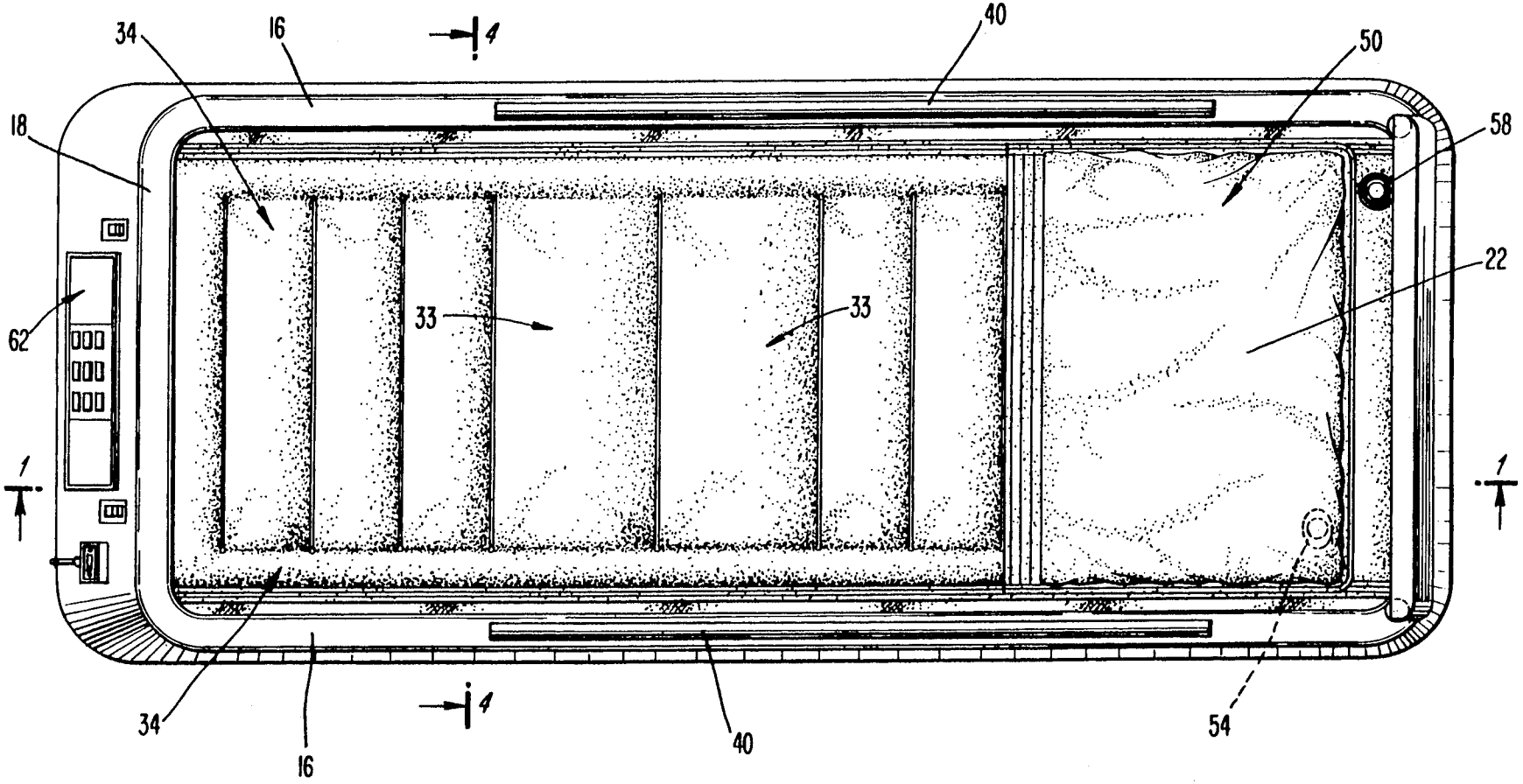
FIG. 3 is a top plan view of said illustrative embodiment.

Water is charged into and discharged from water chamber 32 through port 58, as shown in FIGS. 3, 7 and 8.

A heating element, not shown, for heating the water within first chamber 32 is encased within a housing, not shown, which is positioned atop bottom wall 14. First chamber 32 overlies said housing; if water were to leak from first chamber 32 for any reason, the impervious-to-water housing would insure that the heating element could not make contact with the water. However, if the housing was not impervious to water for any reason, an isolation transformer, not shown, is provided to lift earth ground and to thereby insure against electrical shock to the patient.

As an additional precaution, a humidity detector, not shown, and a ground fault plug, not shown, are provided to interrupt current flow to the heating element if needed.

More particularly, the isolation transformer is housed within a hollow cavity 60 within transverse end wall 18. A blower vacuum pump and motor assembly is also housed within said cavity; it handles the rapid inflation and deflation of second chamber 32 as well as third chamber 50.

Control panel 62, shown in FIGS. 1 and 2, houses the controls for the novel bed; it is shown in detail in a separate disclosure filed by the present inventor.

Frame 20, mentioned earlier, includes upper part 64 in the form of a rectangular frame and a lower part 66 of similar construction. Lower part 66 is stationary, but upper part 64 is displaceable in a vertical plane as indicated by a comparison of FIGS. 1 and 2. Monolithic glass fiber base 12 is carried by upper frame part 64; accordingly, raising said upper part 64 into the FIG. 2 position lifts the three-section mattress and facilitates the health care personnel in lifting patients from or depositing patients onto the bed 10.

Figure 4:
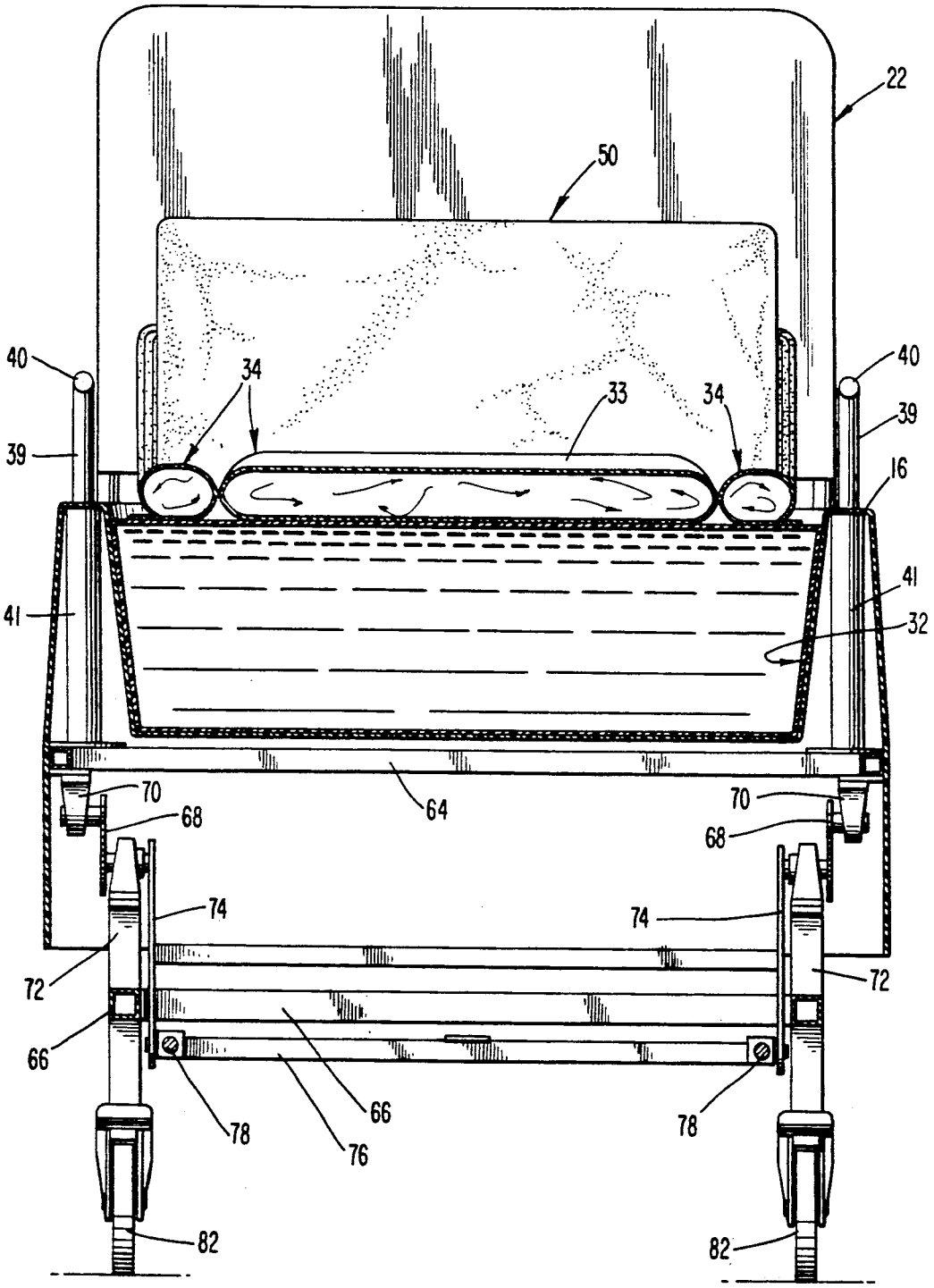
FIG. 4 is a transverse sectional view thereof, taken along line 4—4 in FIG. 3.
Figure 5:
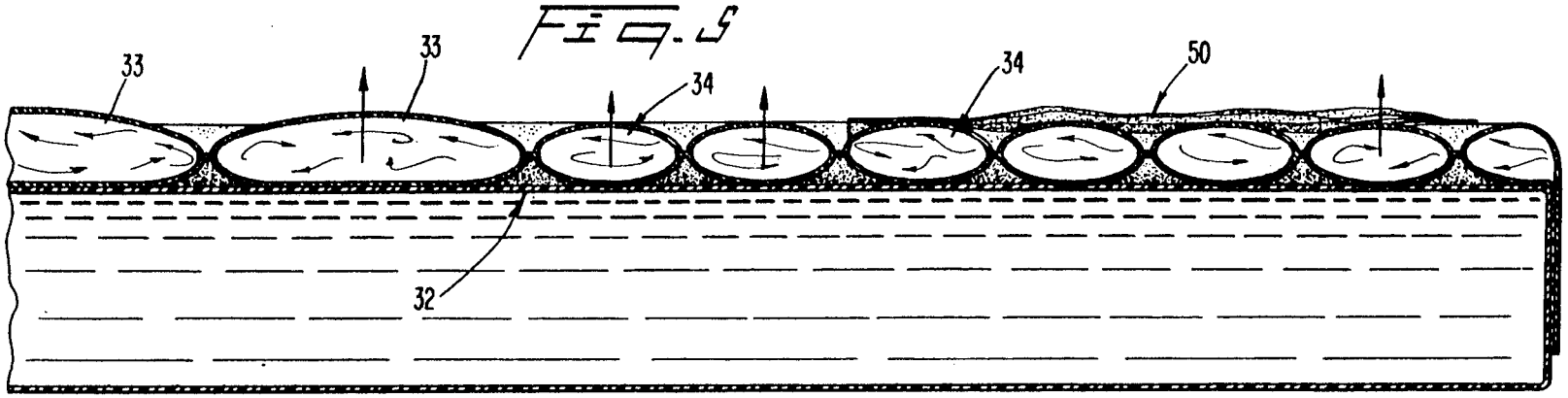
FIG. 5 is a side elevational view of the three chambered mattress when the first chamber is filled with water, the second chamber is filled with air, and the third chamber is deflated.

As best understood in connection with FIGS. 1, 2 and 4, a first link member 68 has its opposite ends pivotally mounted to pivot base 70, there being a pair of transversely spaced apart pivot bases 70 depending from the opposite, longitudinally spaced apart opposite ends of upper frame 64, and pivot base 72, there being a pair of transversely spaced pivot bases 72 fixedly secured to and projecting upwardly from and in upstanding relation to lower frame member 66.

A second plurality of link members 74 are similarly pivotally mounted between their associated pivot bases 72 and an associated transverse rod 76 (FIG. 4). Forward and rearward transverse rods 76 are interconnected by a pair of transversely spaced, longitudinally extending and axially displaceable rods 78. The angle between links 68 and 74 is fixed so that axial displacement of rods 78, effected by a motor, not shown, in housing 80 at the foot of the bed, effects simultaneous and corresponding rotation of said link members and hence vertical displacement of said bed in the absence of lateral and longitudinal displacement.

Due to its light weight, bed 10 is moveable on casters 82.

This invention is clearly new and useful. Moreover, it was not obvious to those of ordinary skill in this art at the time it was made, in view of the prior art, considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A bed, comprising:

a base member having an elongate flat bottom wall, a pair of transversely disposed end walls formed integrally therewith at opposite ends thereof, and a pair of longitudinally extending side walls formed integral thereto;

an upwardly opening cavity means collectively defined by said end walls, said bottom wall, and said side walls;

a three-chambered mattress member configured and dimensioned to fit within said cavity means;

a first, lowermost chamber of said mattress adapted to be at least partially filled with water;

a second chamber of said mattress adapted to be at least partially filled with air;

said second chamber having a length and width substantially equal to the length and width of said first chamber;

a third chamber, positioned atop said first and second chambers, adapted to be at least partially filled with air;

said third chamber having a length about one-third that of said first and second chambers, said third chamber extending longitudinally from a preselected end of said second chamber;

said third chamber having a wedge-shaped profile when filled with air and when viewed in side elevation;

means for selectively inflating and deflating said second and third chambers so that a patient is easily delivered to or removed from or turned over on said bed when said second chamber is inflated and said third chamber is deflated and whereby a patient is held in at least a partially sitting-up position when said third chamber is inflated;

a rectangular upper frame and a rectangular lower frame;

a pair of transversely spaced apart pivot bases depending from each opposite, longitudinally spaced apart end of each upper frame, so that there are four of said depending pivot bases secured to said upper frame;

a pair of transversely spaced apart pivot bases fixedly secured to and projecting upwardly from each opposite, longitudinally spaced apart end of each lower frame, so that there are four of said upstanding pivot bases secured to said lower frame;

a first plurality of rigid link members of linear configuration, each link member of said first plurality of link members being disposed in interconnecting relation between an associated depending pivot base and upstanding pivot base and each of said link members being pivotally secured at its opposite ends to said associated pivot bases;

a second plurality of rigid link members of linear configuration, each link member of said second plurality of link members having a first, upper end pivotally secured to an associated upstanding pivot base;

a pair of elongate, transversely spaced, longitudinally disposed and axially displacable rods of linear configuration being disposed in interconnecting, pivotally mounted relation to respective second, lower ends of said second plurality of link members;

each of said first and second link members being disposed in a preselected angular relation with respect to one another and being fixedly secured to one another at the respective ends thereof that are pivotally secured to said upstanding pivot bases;

means for effecting simultaneous axial displacement of said rods; and said first and second plurality of link member maintaining their preselected angular relation as said second, lower ends of each of said link members of said second plurality of link members are displaced by axial displacement of said rods.

2. The bed of claim 1, further comprising means for regulating the temperature of said water in said first chamber within a preselected range.

3. The bed of claim 1, wherein a preselected end wall of said base member is hollow and has a capacity sufficient to accommodate a blower vacuum pump and motor assembly, and a control panel means.

4. The bed of claim 1, wherein said second chamber includes a plurality of transversely extending sections, and wherein preselected sections are enlarged with respect to nonselected sections so that said preselected sections, when fully inflated, support a patient's lower back.

5. The bed of claim 1, further comprising a pair of side rail members that are telescopically mounted with respect to said side walls and further comprising means for locking said side rails in a raised configuration and means for unlocking said side rails so that said side rails may be lowered.

6. The bed of claim 1, wherein said means for effecting axial displacement of said rods is a motor means.

* * * * *